US008671512B2

(12) United States Patent
Qian et al.

(10) Patent No.: US 8,671,512 B2
(45) Date of Patent: Mar. 18, 2014

(54) CYCLONE CLEANER

(75) Inventors: Dongqi Qian, Suzhou (CN); Shoumu Wang, Suzhou (CN)

(73) Assignee: TEK Electrical (Suzhou) Co., Ltd., Suzhou, Jiangsu (CN)

( * ) Notice: Subject to any disclaimer, the term of this patent is extended or adjusted under 35 U.S.C. 154(b) by 429 days.

(21) Appl. No.: 12/999,548

(22) PCT Filed: May 12, 2009

(86) PCT No.: PCT/CN2009/071739

§ 371 (c)(1),
(2), (4) Date: Dec. 16, 2010

(87) PCT Pub. No.: WO2009/152710

PCT Pub. Date: Dec. 23, 2009

(65) Prior Publication Data

US 2012/0023700 A1 Feb. 2, 2012

(30) Foreign Application Priority Data

Jun. 20, 2008 (CN) ..... 200810126689.7

(51) Int. Cl.
*A47L 9/16* (2006.01)

(52) U.S. Cl.
USPC ..... 15/353; 15/327.6; 15/347

(58) Field of Classification Search
USPC ..... 15/347, 327.6, 350–353; 55/343, 345, 55/346, 349, 459.1, DIG. 3
See application file for complete search history.

(56) References Cited

U.S. PATENT DOCUMENTS

| | | | | |
|---|---|---|---|---|
| 5,080,697 | A * | 1/1992 | Finke | 95/268 |
| 5,295,854 | A | 3/1994 | Olson | |
| 6,334,234 | B1 * | 1/2002 | Conrad et al. | 15/347 |
| 6,874,197 | B1 * | 4/2005 | Conrad et al. | 15/353 |
| 7,329,295 | B2 * | 2/2008 | Greene et al. | 55/337 |
| 7,395,579 | B2 * | 7/2008 | Oh | 15/347 |

FOREIGN PATENT DOCUMENTS

| | | | |
|---|---|---|---|
| CN | 1245450 | A | 2/2000 |
| CN | 2684751 | | 3/2005 |
| CN | 1606952 | A | 4/2005 |
| CN | 1626025 | A | 6/2005 |
| CN | 201223346 | | 4/2009 |
| DE | 398849 | C | 7/1924 |
| JP | U52-052872 | | 4/1977 |
| JP | U52-138367 | | 11/1977 |
| JP | U53-141859 | | 11/1978 |
| JP | 7222704 | A | 8/1995 |
| JP | 2004154214 | A | 6/2004 |
| JP | 2004201875 | A | 7/2004 |
| JP | 2007167451 | A | 7/2007 |
| WO | 0160524 | | 8/2001 |

* cited by examiner

*Primary Examiner* — Dung Van Nguyen
(74) *Attorney, Agent, or Firm* — Lando & Anastasi, LLP

(57) ABSTRACT

The present invention relates to a cyclonic vacuum cleaner comprising a main body of vacuum cleaner, in which a cyclonic separating device and a suction device are provided. The cyclonic separating device comprises a chamber body enclosed by a side wall and a base plate, and is provided with an air inlet and an air outlet. After entering the chamber body, air flow swirls along the inner wall of chamber body, forms cyclonic separation air flow and makes air-solid separation. The separated air flow enters the suction device via the air outlet, and the body of the suction device is at least partially inserted into the cyclonic separation air flow. The cyclonic vacuum cleaner of the present invention is featured by reduced volume and compact structure, not only facilitating the use of such product, but also providing more space for the product design while providing the desired dust separation effect.

13 Claims, 11 Drawing Sheets

CYCLONE CLEANER

FIELD OF THE INVENTION

The present invention relates to a cyclonic vacuum cleaner and particularly to a cyclonic vacuum cleaner with compact structure and smaller volume.

DESCRIPTION OF THE PRIOR ART

At present, the conventional cyclonic vacuum cleaners available by prior art are configured with a cyclonic separating device and a suction device in their main bodies. The cyclonic separating device comprises a cyclone separator which is provided with an air inlet, an air outlet and a dust collecting vessel. The suction device is used to draw in air flow so that air flow enters the cyclone separator for air-solid separation. Then, under the sucking action of the suction device, clean air is released to atmosphere. The suction devices in the conventional vacuum cleaners are located outside the cyclonic separating devices, generally, above or below the cyclonic separating devices, as is disclosed in the patent CN1434688A (Applicant: LG Electronics). FIG. 1 shows the schematic internal structure of the multi-stage cyclonic vacuum cleaner involved in said patent. As shown in FIG. 1, the main body of the vacuum cleaner A comprises a cyclonic separating device 100 and a suction device 200, said suction device 200 sets below the cyclonic separating device 100. Under the sucking action of the suction device 200, the air flow with dust and other particles enters the cyclonic separating device 100 in a tangential direction via the air inlet. Under the centrifugal force, the air and dirt are separated; and the dirt including dust and particles are trapped in the dust collecting vessel of the cyclonic separating device 100; while the clear air is expelled to the atmosphere under the sucking action of the suction device 200, so that of the dirt cleaning objective is achieved.

To some degrees, the air-dust separation effect of this type of vacuum cleaner is related to the length of the inner chamber of the cyclone separator. To guarantee the desired effect of cyclone separation, the inner chamber of the cyclone separator has to reach certain length. Further, the suction device 200 also occupies certain room in the axial direction of the cleaner; therefore, the volume of the present cyclonic vacuum cleaners is undesirably bigger due to the above mentioned positional relationship between the suction device and the cyclonic separating device, having a disadvantageous affect on its use and shape design.

SUMMARY OF THE INVENTION

In view of the deficiency of the prior art, it is the technical object of the present invention to provide a cyclonic vacuum cleaners which is featured by compact structure and smaller volume, and which provides guaranteed dust separation effect, such as to provide great conveniences for both customer use and product design.

The technical object of the present invention is achieved by adopting the following technical solution:

The cyclonic vacuum cleaner provided in this invention comprises a main body, in which a cyclonic separating device and a suction device are set. The cyclonic separating device comprises a chamber body enclosed by side wall and base plate, and is provided with an air inlet and an air outlet. After entering the chamber body, the air flow swirls along the inner wall of the chamber and forms cyclonic separation air flow and causes gas-solid separation. The separated air flow enters the suction device from the air outlet, and the body of the suction device is at least partially inserted into the cyclonic separating air flow.

According to different requirements for the structure of the vacuum cleaner, the suction device body should at least partially shares the chamber body of the cyclonic separating device. To facilitate dumping the dirt, it is also feasible to set up an independent casing on the outside of the suction device body, so as to isolate the suction device from the chamber body of the cyclonic separating device.

To realize more reasonable layout of the vacuum cleaner, it is feasible to arrange the suction device and the cyclonic separating device are mounted coaxially with respect to each other.

To guarantee the desired dust suction effect of the vacuum cleaner, a central filter is further provided in the main body of the cyclonic cleaner, the central filter and the cyclonic separating device are arranged in series.

The central filter and the cyclonic separating device are mounted coaxially with respect to each other, for the same structural design concern.

In addition, according to the requirement of the shape design, the suction device may be set on the upper end or the lower end of the cyclonic separating device.

Generally, to guarantee better dust suction effect, a cyclonic separating device is a multi-stage cyclonic separating device, which is composed of a primary cyclonic separating device and a secondary cyclonic separating device arranged in series; wherein, the secondary cyclonic separating device consists of a plurality of secondary cyclone separators arranged in parallel with one another. The secondary cyclone separators are provided above or below the primary cyclone separator, and are at least partially enclosed in the chamber body of the cyclonic separating device.

As compared with the prior art, the present invention brings about the following beneficial effects: the entire vacuum cleaner is of smaller volume for a given axial length of the cyclonic air flow in the inner chamber of the cyclonic separating device; because the body of suction device is at least partially inserted into the cyclonic air flow so that a part or the entire the suction device is embedded in the cyclonic air flow in the chamber body of cyclonic separating device. That is to say, while the desired dust separation effect is guaranteed, the volume of the cyclonic vacuum cleaner is correspondingly reduced in this invention, which not only provides convenience for the users, but also provides more available space for the product design.

The following is the detailed description of the present invention in combination with the attached drawings and the specific embodiments.

DETAILED DESCRIPTION OF THE PREFERRED EMBODIMENTS

Embodiment 1

Figure 1:
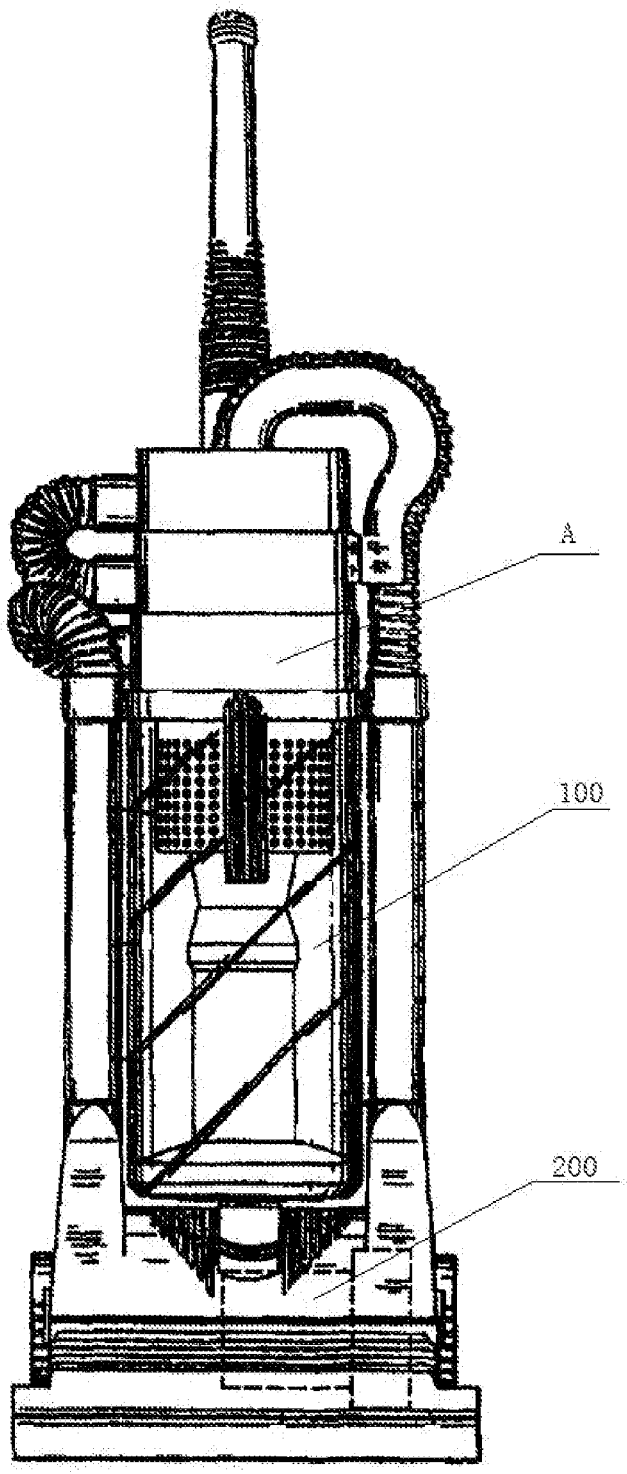
FIG. 1 is an internal structure view of the vacuum cleaner of the prior art.
Figure 2:
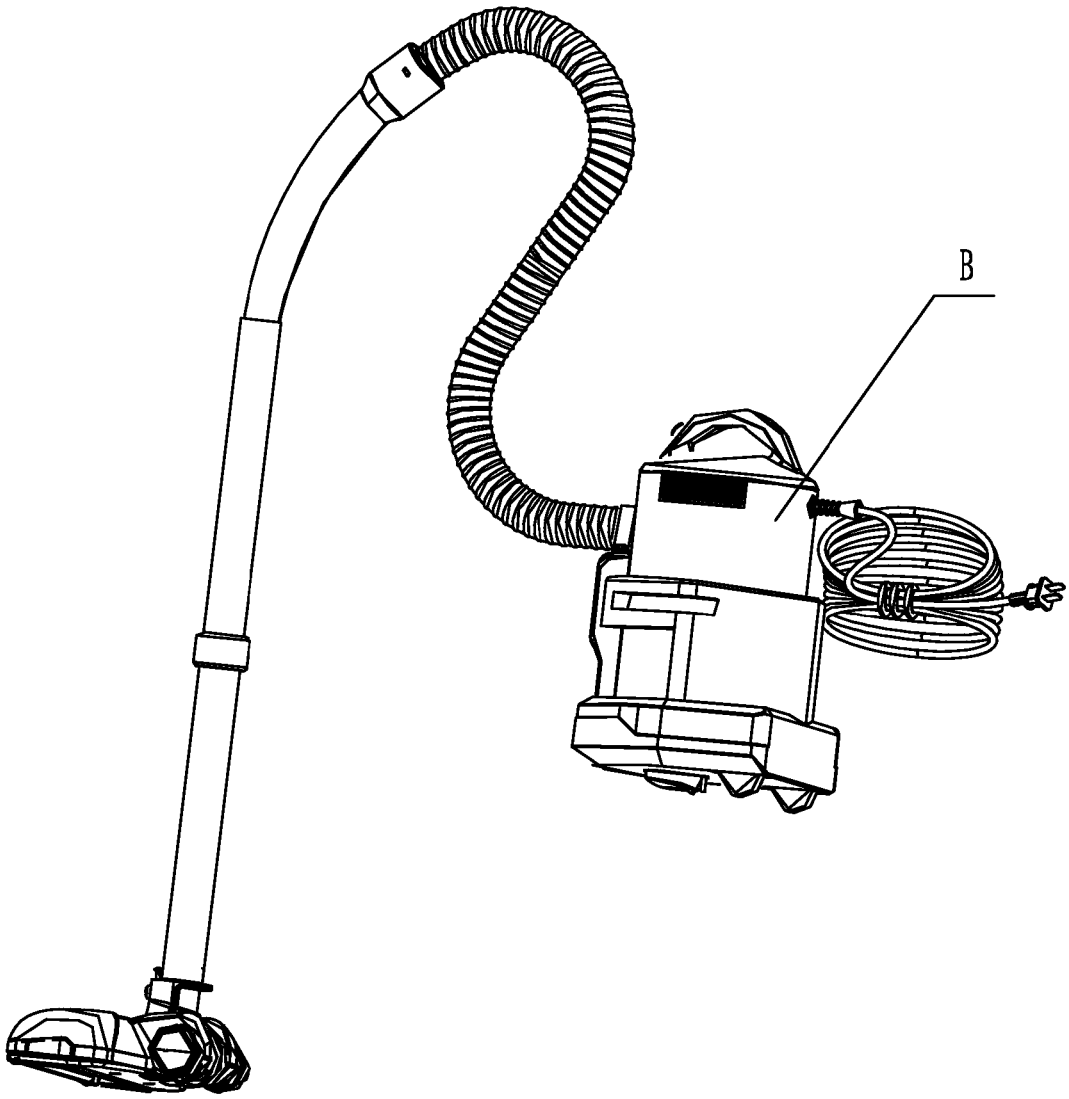
FIG. 2 is a three dimensional view of the vacuum cleaner in embodiment 1 of the present invention.
Figure 3:
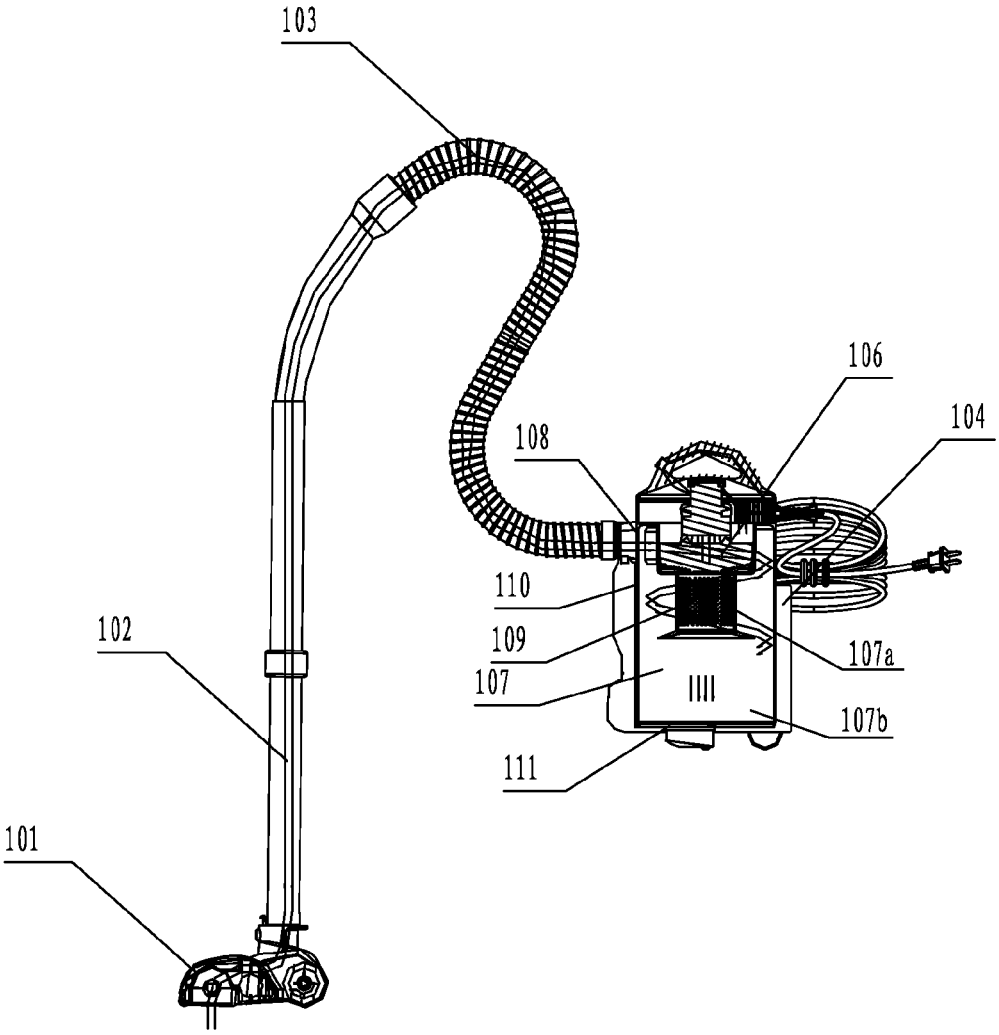
FIG. 3 is a cross sectional view of the main body of vacuum cleaner in the embodiment 1 of the present invention.

FIG. 2 is the three dimensional view of the vacuum cleaner in embodiment 1 of the present invention, and FIG. 3 is the cross sectional view of the main body of the vacuum cleaner in the embodiment 1 of the present invention. As shown in FIG. 2, this embodiment provides a vacuum cleaner B with a single stage dust separation function. As shown in FIG. 3, this vacuum cleaner B comprises a main body 104 of vacuum cleaner, a cyclonic separating device 107 and a suction device 106 that are provided in the main body 104. The cyclonic separating device 107 comprises a chamber body enclosed by a side wall 110 and a base plate 111, and the lower end of the chamber body forms a cyclone dust-collecting area 107*b*. The cyclonic separating device 107 is provided with an air inlet 108 and an air outlet 109, and the air inlet 108 is arranged along a tangential direction to the side wall 110 of the cyclonic separating device 107. The suction device 106 is located above the air outlet 109. The separated air flow is expelled via the air outlet 109 and enters the suction device 106. The air outlet 109 is generally formed by a shroud which its wall having multiple through-holes, and is used to filter the dirt particles remaining in the air flow in the process when the air flow is discharged from the air outlet 109. In this embodiment, the body of the suction device 106 is partially embedded in the chamber body of the cyclonic separating device 107, so that the body of the suction device 106 is partially inserted into the cyclonic air flow of the cyclonic separating device 107 and the space between the outside of the suction device 106 and the side wall 110 is therefore sufficiently utilized. In this part of space, the cyclonic air flow is still subject to cyclone separation.

In FIG. 3, the air flow direction is indicated as the double dotted lines. Specifically, the air flow with dust and dirt particles runs from the suction port of a floor brush 101 and enters the inner chamber of the cyclonic separating device 107 by way of a hard tube 102, a hose 103 and an air inlet 108. The air flow with dust and dirt particles enters the chamber body along the tangential direction and moves spirally in it, and the air-solid separation is realized under centrifugal force. The cyclonic separating device 107 mainly comprises a cyclone separator 107*a*. The separated dust and dirt particulars are trapped on a base plate 111 of the cyclone dust-collecting area 107*b* at the lower part of the chamber body. Under the sucking action of a suction device 106, clean air flow is expelled via the air outlet 109 and is discharged to the atmosphere. To realize more reasonable layout of the vacuum cleaner, the suction device 106 and the cyclone separator 107*a* are arranged coaxially with respect to each other in this embodiment. To facilitate the vacuum cleaner to empty the waste, the connection between the base plate 111 and the side wall 110 can be realized by the means of a pivot, or a fastener or other means (Not shown in the FIG).

Embodiment 2

Figure 4:
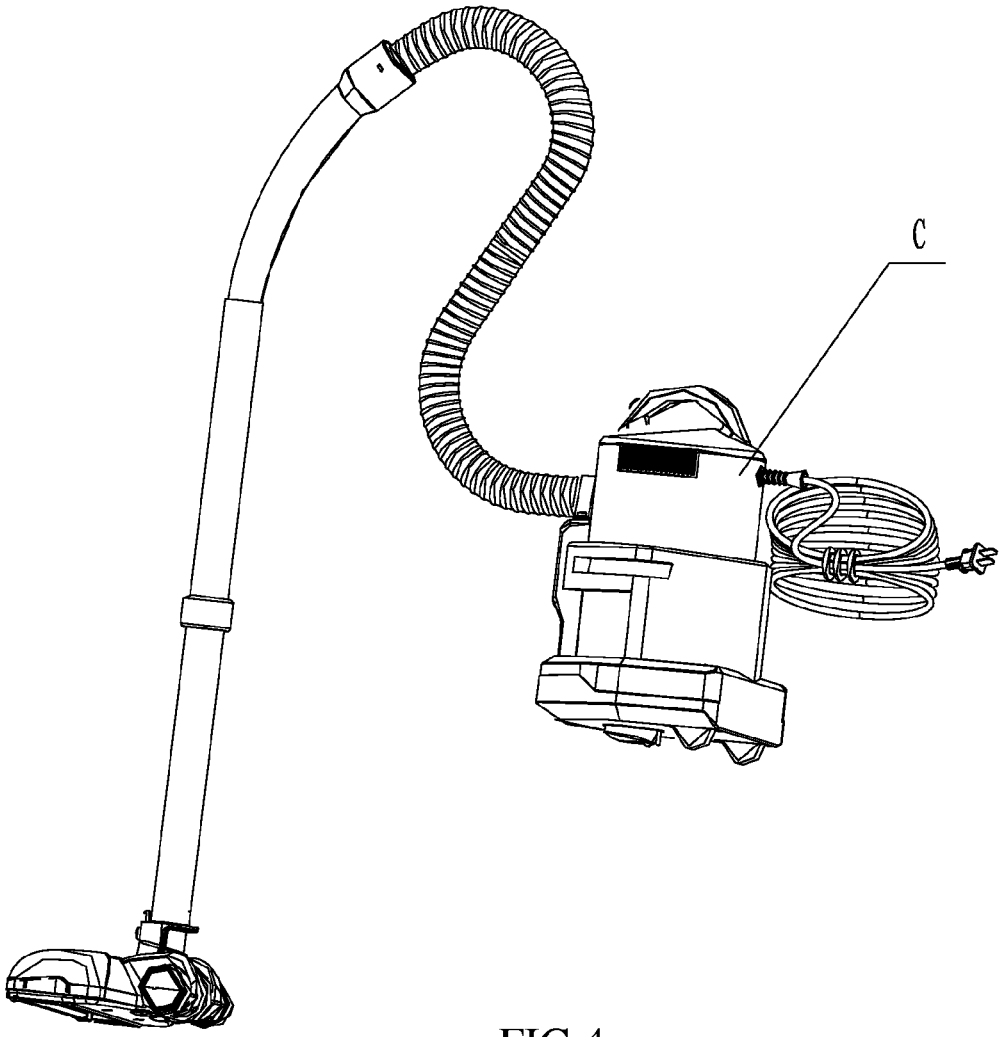
FIG. 4 is a three dimensional view of the vacuum cleaner in embodiment 2 of the present invention.
Figure 5:
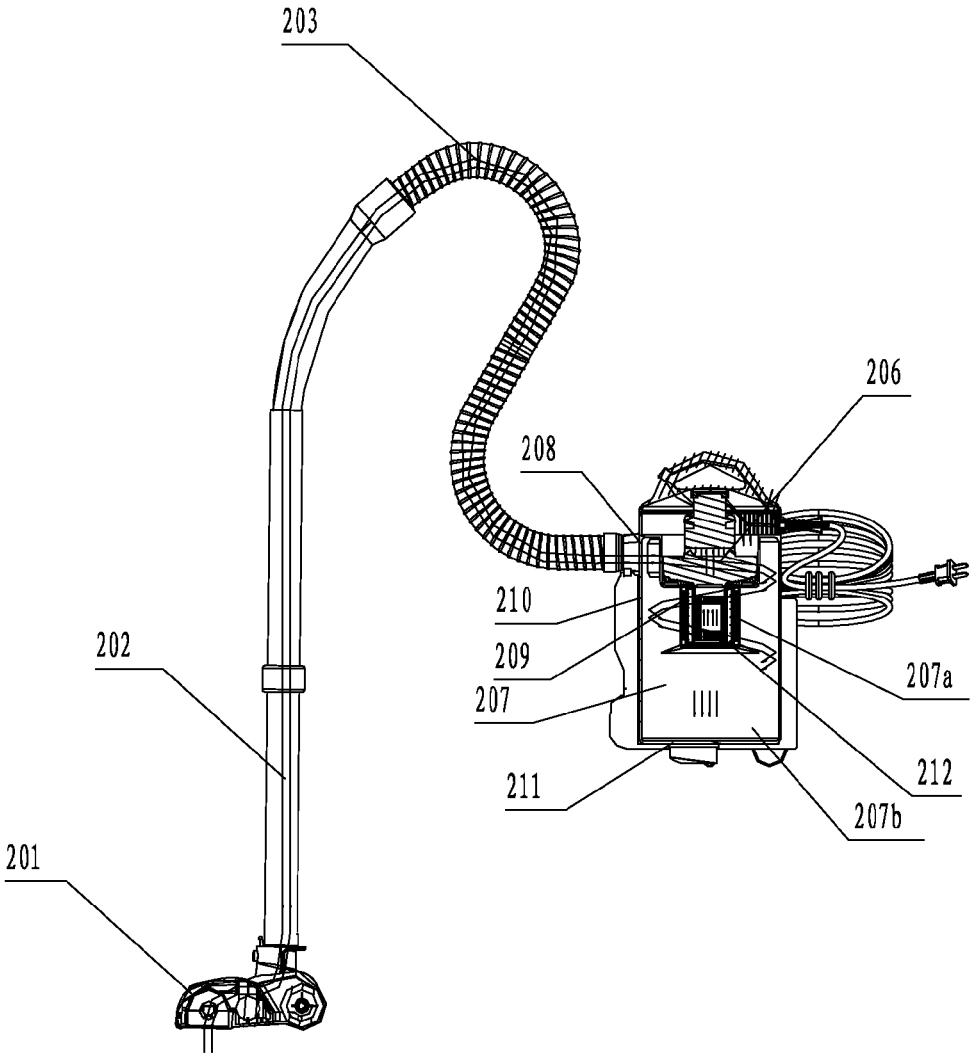
FIG. 5 is a cross sectional view of the main body of vacuum cleaner in the embodiment 2 of the present invention.

FIG. 4 is the three dimensional view of the vacuum cleaner in embodiment 2 of the present invention, and FIG. 5 is the cross sectional view of the main body of the vacuum cleaner in embodiment 2 of the present invention. As shown in FIG. 4, the embodiment 2 of the present invention provides a vacuum cleaner C with secondary dust separation function. As shown in FIG. 5, the cyclonic separating device 207 of the vacuum cleaner C mainly comprises a cyclone separator 207*a*, wherein, the lower end of the cyclone separator 207*a* forms a cyclone dust-collecting area 207*b*, which is used to store the dust and dirt particles separated from the air flow. The air outlet 209 of the cyclonic separating device 207 may be formed in like manner as described in the embodiment 1, as a shroud which its wall having multiple through-holes, or it may involves using coarser filter materials, such as sponge and nylon wire, to filter the dust and dirt particles in the air flow. The main differences between this embodiment 2 and the embodiment 1 consist in that a central filter 212 is provided at the downstream of the cyclone separator 207*a* in cascade connection to guarantee the dust suction effect of the vacuum cleaner, wherein, the central filter 212 and the cyclone separator 207*a* are configured coaxially with respect to each other, and the central filter is a HEPA (high efficiency particulate air filter) or a ULPA (Ultra high efficiency particulate air filter). As shown in FIG. 5, the central filter 212 according to this embodiment is located inside the air outlet 209 of the cyclonic separating device 207. However, the location of the central filter 212 can be adjusted in practical application according to different layout designs. For examples, the central filter 212 may be set at the upper part or lower part of the air outlet 209 of the cyclonic separating device 207, and the air inlet 208, the air outlet 209, the central filter 212 and the suction device 206 are connected sequentially. In this embodiment, the suction device 206 is partially embedded in the chamber body of the cyclonic separating device 207, more precisely, the suction device 206 is partially inserted into the cyclonic air flow of the cyclone separator 207*a* and is located above the air outlet 209 and the central filter 212, so that the space between the outside of suction device 206 and the side wall 210 is also sufficiently utilized, wherein the cyclonic air flow is still subjected to effective cyclone separation.

As shown in FIG. 5, wherein the air flow direction is indicated as the double dotted lines, the operation process of the vacuum cleaner provided in this embodiment is described as follows: The air flow with dust and dirt particles entering the inner chamber of cyclonic separating device 207 from the suction port of a floor brush 201 by way of a hard tube 202, a hose 203 and an air inlet 208, moves spirally inside the cyclonic separating device and forms cyclonic air flow, and thus makes dirt-air separation for the first time; The dust and dirt particles separated from the air flow are trapped on the base plate 211 of cyclonic separating device 207; After passing through the air outlet 209 which be formed by a shroud having multiple through-holes, the air flow with smaller quantity of particles enters the central filter 212, wherein a secondary dust separation occurs, the dust and dirt are thoroughly removed from the air flow; Then under the sucking action of the suction device 206, clean air flow is discharged to the atmosphere.

Since the other technical characteristics in this embodiment are identical to those in the embodiment 1, unnecessary details will be omitted herein.

Embodiment 3

Figure 6:
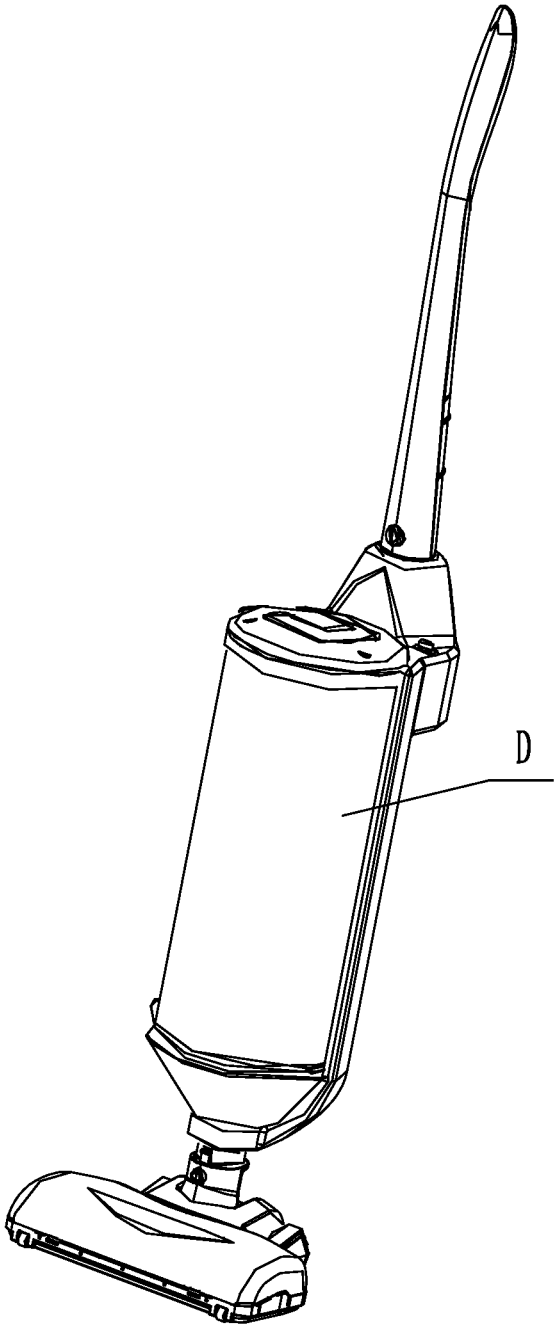
FIG. 6 is a three dimensional view of the vacuum cleaner in the embodiment 3 of the present invention.
Figure 7:
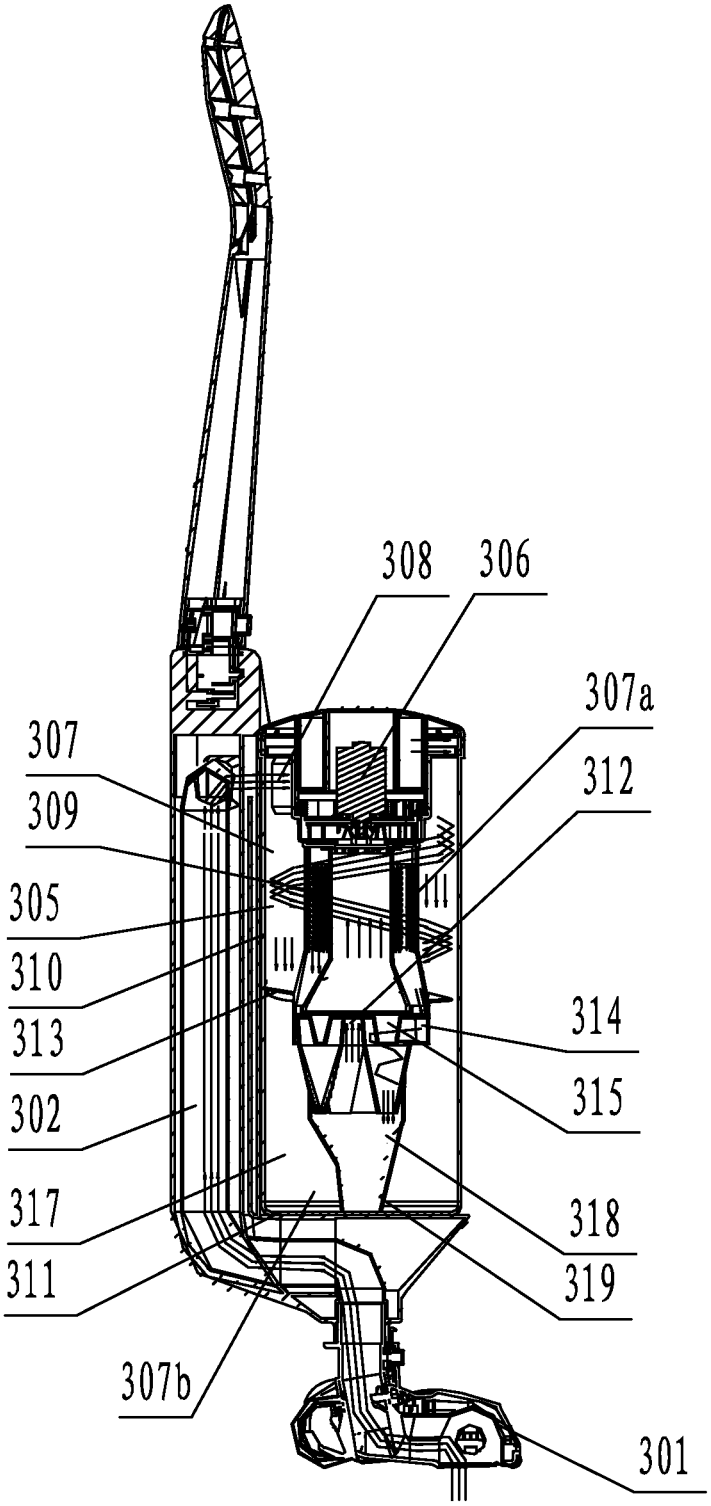
FIG. 7 is a cross sectional view of the main body of vacuum cleaner in the embodiment 3 of the present invention.

FIG. 6 is the three dimensional view of the vacuum cleaner according to embodiment 3 of the present invention, and FIG. 7 is the cross sectional view of the main body of the vacuum cleaner in embodiment 3 of the present invention. As shown in FIG. 6, this embodiment provides a vacuum cleaner D with a secondary dust separation function. As shown in FIG. 7, this embodiment differs from the aforementioned two embodiments in that, the cyclonic separating device in this embodiment is a multi-stage cyclonic separating device, which is composed of a primary cyclone separator and a secondary cyclone separator arranged in series; wherein, the secondary cyclone separator includes a plurality of secondary cyclone separators arranged in parallel with one another. The secondary cyclone separators are located below the primary cyclone separator, and are enclosed at least partially in the chamber body of the cyclonic separating device.

More specifically, as shown in FIG. 7, the cyclonic separating device 305 comprises a primary cyclonic separating device 307 and a secondary cyclonic separating device 317. The primary cyclonic separating device 307 comprises a primary cyclone separator 307*a*, a baffle 313 with through-hole and a primary dust-collecting area 307*b* enclosed by a side wall 310 and a base plate 311. The primary dust-collecting area 307*b* is used to store the dust and dirt particles separated from the primary cyclone separator 307*a*. At least one through-hole is provided on the baffle 313. The secondary cyclonic separating device 317 comprises a secondary cyclone separator 312 and a secondary cyclone dust-collecting area 318. The secondary cyclone separator 312 is composed of a plurality of cyclone separators arranged in parallel with one another, whose rotation axis are distributed on a circumference around the rotation axis line of the primary cyclone separator 307*a*. In this embodiment, the secondary cyclone separators 312 are located below the primary cyclone separator 307*a*. The secondary cyclone dust-collecting area 318 is enclosed by the side wall 319 and the base plate 311, and this area is used to store the dust and dirt particles separated from the secondary cyclone separators 312. The primary cyclone dust-collecting area 307*b* is located in the periphery of the secondary cyclone separators 312 and the secondary cyclone dust-collecting area 318 enclosing the secondary cyclone separators 312 and the secondary cyclone dust-collecting area 318. To facilitate the vacuum cleaner to empty the waste, the connection between the base plate 111 and the side wall 110 may be realized by the means of a pivot or a fastener or other means.

In this embodiment, the suction device 306 is set in the inner chamber of the primary cyclonic separating device 307, partially embedded in the primary cyclone separator 307*a* at a location above the air outlet 309 and the secondary cyclone separator 312. The cyclonic air flow is still subject to effective cyclone separation in the space between the suction device 306 and the side wall 310.

As shown in FIG. 7, the operation process of the vacuum cleaner provided in this embodiment is described as follows: the air flow with dust and dirt running from the suction port of a floor brush 301 entering the inner chamber of the cyclonic separating device 307 by way of an airduct 302 and an air inlet 308, moves spirally in the inner chamber of the primary cyclonic separating device 307 and forms cyclonic air flow, thus making dust separation for the first time; The dust and dirt particles separated from air flow are trapped in the primary cyclone dust-collecting area 307*b* via the through-hole on the base plate 313. The air flow with small quantity of particles from the air outlet 309 enters the secondary cyclone separator 312 via air inlet 314, and it moves spirally in the inner chamber of the secondary cyclonic separating device 317 and forms the cyclonic air flow, and thus making cyclonic separation for the second time. Small quantities of dust and dirt particles separated from air flow are trapped in the secondary cyclone dust-collecting area 318, particularly, on the base plate 311. Under the sucking action of the suction device 306, clean air flow is expelled to the atmosphere through the air outlet 315 of the secondary cyclone separators 312.

Embodiment 4

Figure 8:
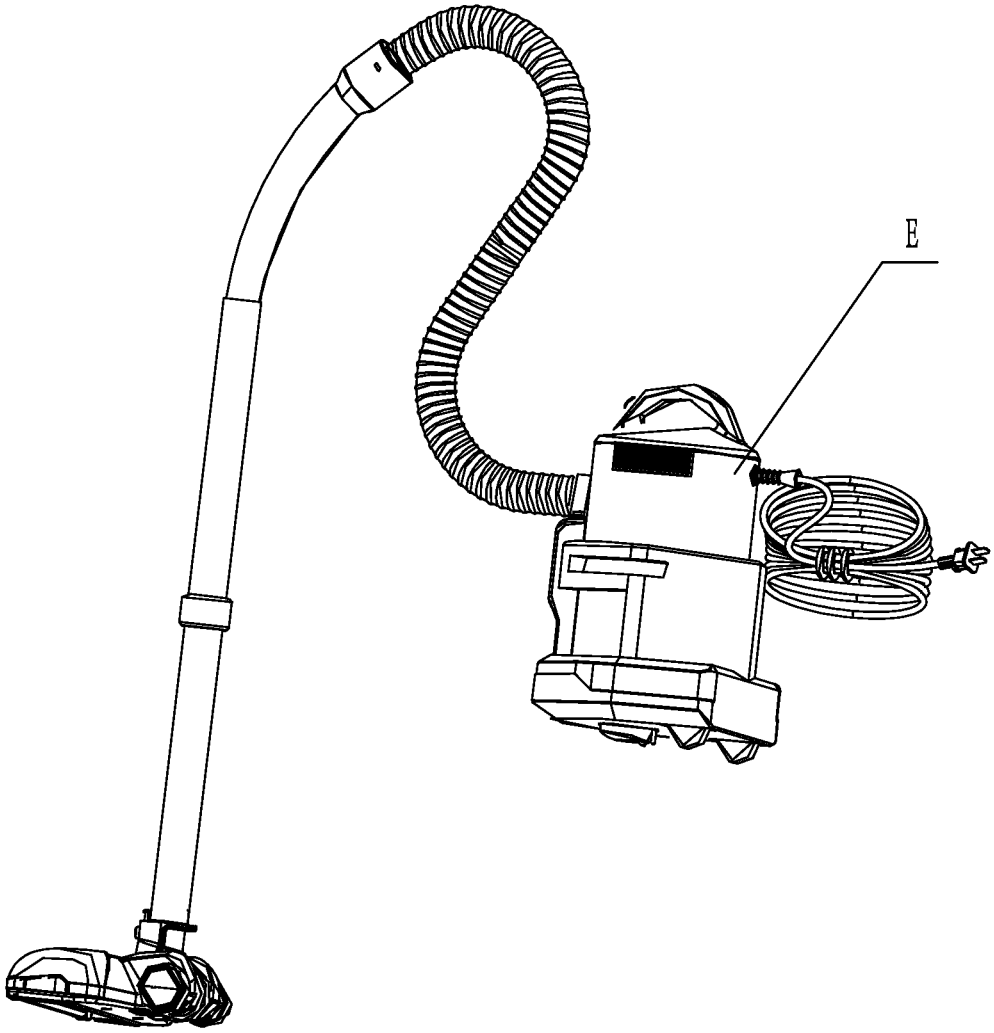
FIG. 8 is a three dimensional view of the vacuum cleaner in the embodiment 4 of the present invention.
Figure 9:
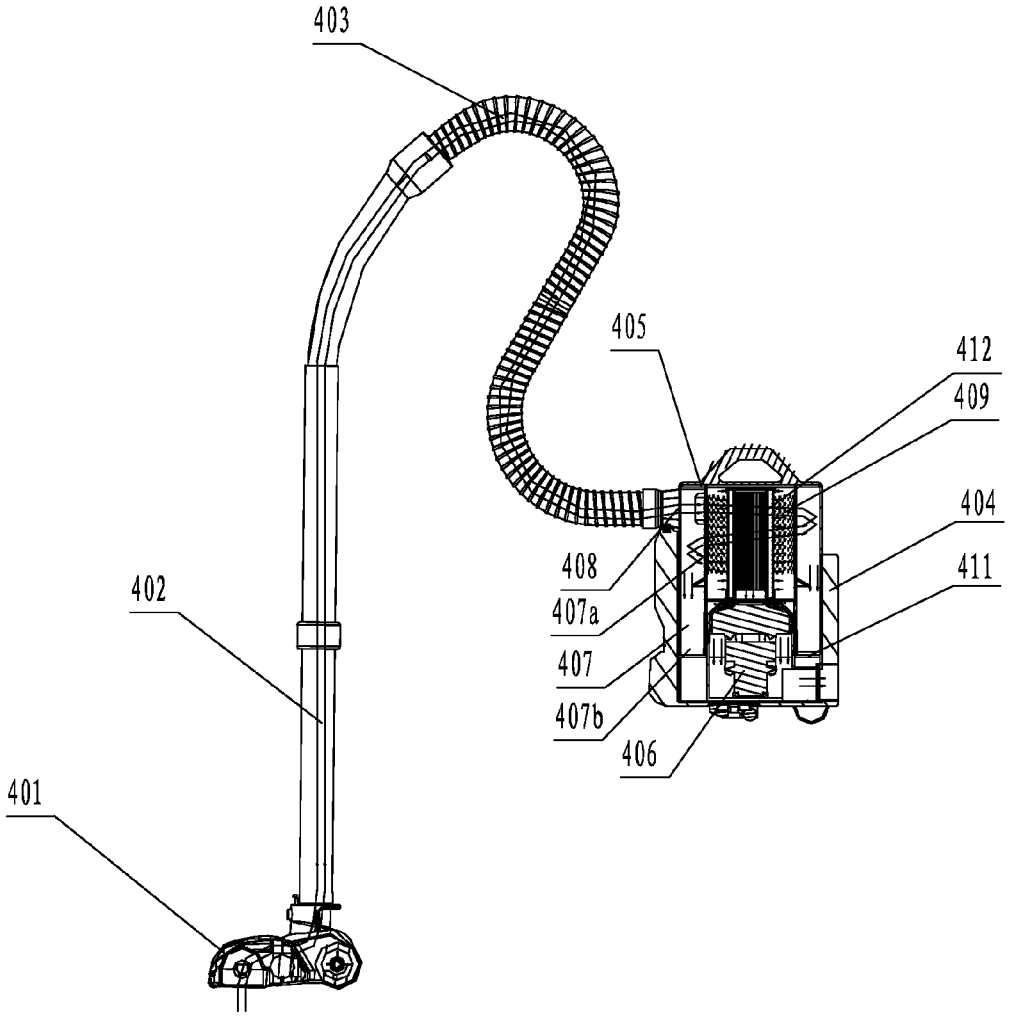
FIG. 9 is a cross sectional view of the main body of vacuum cleaner in the embodiment 4 of the present invention.

FIG. 8 is a three dimensional view of the vacuum cleaner according to embodiment 4 of the present invention; FIG. 9 is the cross sectional view of the main body of vacuum cleaner in embodiment 4 of the present invention. As shown in FIG. 8, this embodiment provides a vacuum cleaner E with secondary dust separation function. As shown in FIG. 9, this embodiment is also an improvement to embodiment 1 similar to embodiment 2 in that both involves a central filter which is located the downstream of the cyclone separator and the central filter is set inside the air outlet. However, in this embodiment, the positional correlation between the suction device, the cyclone separator and the central filter in the vertical direction within the main body of the vacuum cleaner is opposite to that in embodiment 2, and here are adaptive changes in the corresponding structures of the main body accordingly.

Specifically, as shown in FIG. 9, the cyclonic separating device 405 comprises a primary cyclonic separating device 407 and a central filter 412. As observed along the air flow direction in the body of vacuum cleaner, the central filter 412 is still set at the downstream of the primary cyclone separator 407*a*. However, as shown in FIG. 9, the suction device 406 is set below the central filter 412 and the primary cyclone separator 407*a*. In this embodiment, the suction device 406 has an independent casing. At the same time, the suction device 406 is partially embedded in the inner chamber of the primary cyclonic separating device 407. More precisely, the suction device 406 is partially embedded in the inner chamber of the primary cyclone dust-collecting area 407*b*; therefore, the suction device 406 is relatively separated by its casing from the chamber body of the primary cyclone separation device 407. The chamber body part of the primary cyclone separation device 407, which encloses in the periphery of the suction device 406, still makes an effective space for cyclone separation. Due to the above-mentioned structural correlation between the suction device 406 and the primary cyclonic separating device 407, whereby the suction device 406 is mounted in a separate chambers relative to the cyclonic separating device 405, when the cyclonic separating device 405 is taken out of the vacuum cleaner main body 404 to empty the dirt, the suction device 406 may still remain installed on the vacuum cleaner main body 404. In this way, the cyclone separation device 405 is more maneuverable and convenient to use.

As shown in FIG. 9, where the air flow direction is indicated as the double dotted line, the operation process of the vacuum cleaner provided by this embodiment is described as follows: The air flow with dust running from the suction port of a floor brush 401 and entering the inner chamber of the primary cyclonic separating device 407 by way of a hard tube 402, a hose 403 and a air inlet 408, moves spirally movement inside the cyclonic separating device and forms a cyclonic air flow, and thus making dust separation for the first time. The dust and dirt separated from the air flow are trapped on the base plate 411 of the cyclonic separating device. After passing through the mesh filtration structure of the air outlet 409, the air flow with small quantity of particles enters the central filter 412, by which a second time dust air separation is performed so as to thoroughly remove the dust and dirt particles from the air flow. Under the sucking action of the suction device 406, clean air flow is discharged to the atmosphere.

Since the other technical characteristics in this embodiment are identical to those in embodiment 2, unnecessary details will be omitted herein.

Embodiment 5

Figure 10:
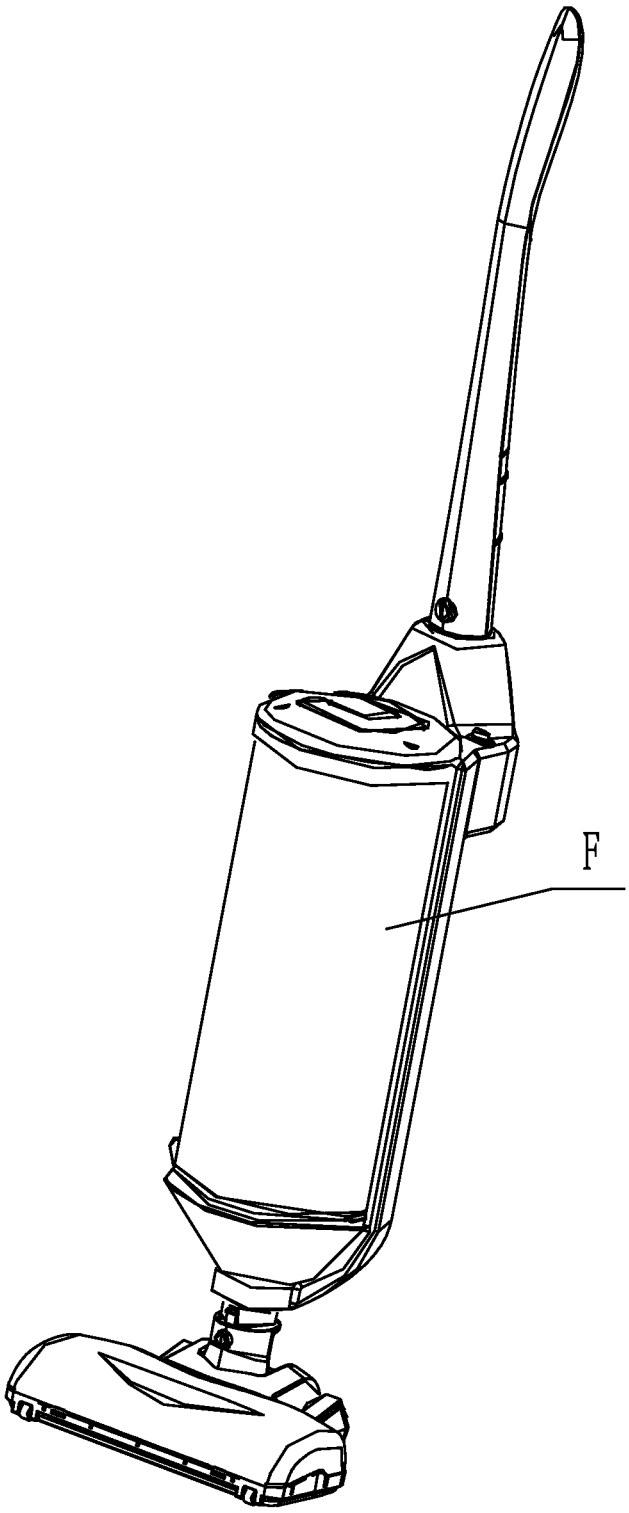
FIG. 10 is a three dimensional view of the vacuum cleaner in the embodiment 5 of the present invention.
Figure 11:
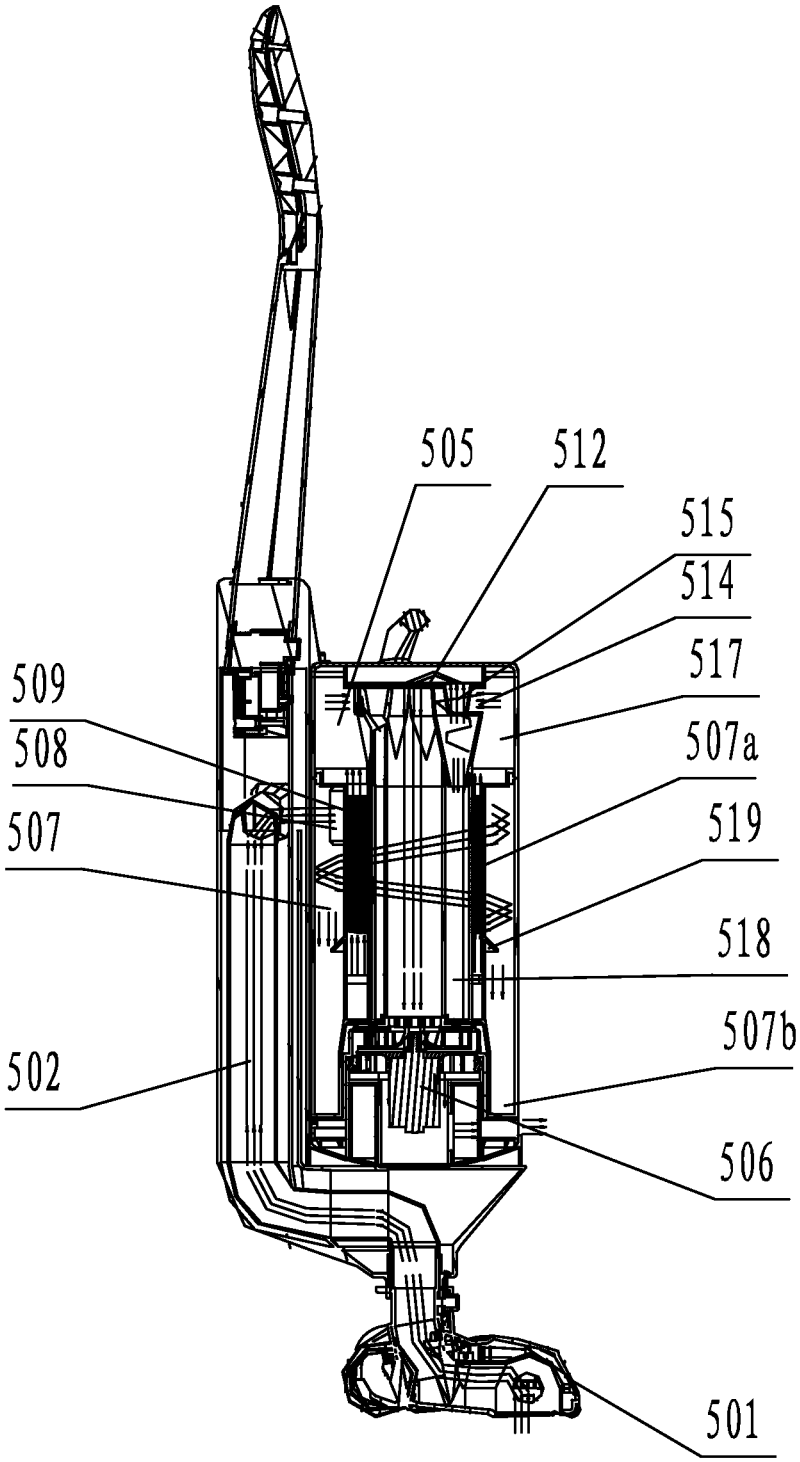
FIG. 11 is a cross sectional of the main body of vacuum cleaner in the embodiment 5 of the present invention.

FIG. 10 is a three dimensional view of the vacuum cleaner according to embodiment 5 of the present invention; FIG. 11 is the cross sectional view of the main body of the vacuum cleaner in the embodiment 5 of the present invention. As shown in FIG. 10, this embodiment provides a vacuum cleaner F with secondary dust separation function. This embodiment is an improvement based on embodiment 3. Both comprise a multi-stage cyclonic separating device. However, this embodiment 5 differs from embodiment 3 in that the vertical positional correlation between the suction device and the multi-stage cyclonic separating device in this embodiment is opposite to that in embodiment 3, and there are adaptive changes in the corresponding structures of the main body accordingly.

As shown in FIG. 11, the cyclonic separating device 505 in this embodiment comprises a primary cyclonic separating device 507 and a secondary cyclonic separating device 517. The air outlet 509 of the primary cyclonic separating device 507 is a shroud having through-holes and a lip 519 extending outwardly. The secondary cyclonic separating device 517 comprises a plurality of secondary cyclone separators 512 arranged in parallel with one another, and they are mounted so that their rotation axis lines are distributed on a circumference around the rotation axis line of the primary cyclone separator 507*a*. The secondary cyclone separators 512 are located below the primary cyclone separator 507*a*. The primary cyclone dust-collecting area 507*b* is located in the periphery of the secondary cyclone separators 512 enclosing the secondary cyclone dust-collecting area 518. In this embodiment, the suction device 506 has an independent casing, and it is partially embedded in the inner chamber of the primary cyclonic separating device 507. More precisely, the suction device 506 is partially embedded in the inner chamber of the primary cyclone dust-collecting area 507*b*. The suction device 506 is located below the air outlet 509, the primary cyclone separator 507*a* and the secondary cyclone separators 512. The suction device 506 is relatively separated by its casing from the chamber body of the primary cyclonic separating device 507. The beneficial effect of this structural correlation is the same as that recited in embodiment 4, unnecessary details will be omitted herein.

As shown in FIG. 11, wherein, the air flow direction is indicated as the double dotted lines, the operation process of the vacuum cleaner provided by this embodiment is described as follows: The air flow with dust running from the suction port of a floor brush 501 and entering the inner chamber of the primary cyclonic separating device 507 by way of a airduct 502 and an air inlet 508, moves spirally inside the primary cyclonic separating device and forms a cyclone air flow, and thus making dust separation for the first time. The dust and dirt separated from air flow are trapped in the primary cyclone dust-collecting area 507*b*. The air flow with small quantity of particles from the air outlet 509 enters the secondary cyclone separator 512 via the air inlet 514, moves spirally in the inner chamber of the secondary cyclonic separating device and forms cyclone air flow, and thus making the dust separation for the second time. The dust and dirt separated from the air flow are trapped in the secondary cyclone dust-collecting area 518. After passing through the air outlet 515 of the secondary cyclone separator 512, clean air flow is discharged to the atmosphere under the sucking action of the suction device 506.

Since the other technical characteristics in this embodiment are identical to those in embodiment 3, unnecessary details will be omitted herein.

As can be seen from the above recited five embodiments, embodiment 1 provides the simplest structure of a basic vacuum cleaner, embodiment 2 and embodiment 4 both provide the central filter as an additional element based on the basic structure of embodiment 1, and embodiment 3 and embodiment 5 both adopt a multi-stage cyclonic separating device based on the basic structure of embodiment 1. In addition, the vertical positional correlation between the suction device and the cyclonic separating device in embodiments 2 and 4 is opposite to that in embodiments 3 and 5; and according to embodiment 4 and embodiment 5, the suction device and the cyclonic separating device are set in separate chambers rather than in shared chamber. Whatever structure each of the embodiments provides, the present invention differs from the prior art in that, the suction device is mounted at least partially in the interior of the cyclone separation air flow in the chamber body of the cyclonic separating device, so that the part of space between the outside of the chamber body of the suction device and the chamber body of the cyclonic separating device may be effectively utilized to make normal cyclone separation. Under the precondition that the flowing space of cyclone air flow in the inner chamber of cyclonic separating device remains unchanged, the volume of vacuum cleaner is reduced correspondingly, its structure becomes more reasonable, and more space is provided for product shape design.

In the practical application, the vacuum cleaner according to embodiment 3 and embodiment 5 may further incorporate a central filter located the downstream of the multi-stage cyclonic separating device so as to realize even better dust removal effect. According to the above recited content of the five embodiments, those skilled in the art are completely able to realize such a combination. In addition, the present invention is also applicable to cyclone separator with vanes, wherein guide vanes are provided at the air inlet of cyclonic separating device, and part of the dirt particle fall off due to their impact and friction with the guide vane when the air flow with dirt particles enters the inner chamber cyclone of the separation device from said air inlet; After passing through the guide vanes, the air flow continues to swirl forward in the chamber body and make coarse gas-solid separation.

To sum up, the protection scope of the present invention is not limited to the specific structures described in the above recited five embodiments in the description. Obviously any modification, addition and structural combination within the spirit and concept of this present invention shall be covered in this application.

What is claimed is:

1. A cyclonic vacuum cleaner comprising a main body comprising a cyclonic separating device and a suction device, the cyclonic separating device having a chamber body enclosed by a side wall and a base plate, an air inlet and an air outlet, the air inlet configured to allow inlet airflow into and along an inner wall of the chamber body, the air outlet configured to allow a portion of a cyclonic air flow formed in the chamber body to exit the chamber body of the cyclonic separating device and enter the suction device, wherein an exterior surface of a body of the suction device is at least partially inserted into an interior of the chamber body of the cyclonic separating device, the exterior surface of the body of the suction device and the side wall of the chamber body configured to define a space to allow a portion of the cyclonic airflow to form.

2. The cyclonic vacuum cleaner according to claim 1, characterized in that at least a portion of the body of the suction device is inserted into the cyclonic airflow formed in the chamber body of the cyclonic separating device.

3. The cyclonic vacuum cleaner according to claim 2, characterized in that at least a portion of the exterior surface of the body of the suction device further includes an independent casing so as to relatively isolate the suction device body from the chamber body of the cyclonic separating device.

4. The cyclonic vacuum cleaner according to claim 1, characterized in that the suction device and the cyclonic separating device are mounted coaxially with respect to each other.

5. The cyclonic vacuum cleaner according to claim 1, characterized in that a central filter is further provided in the main body of the cyclonic vacuum cleaner, the central filter positioned downstream from the cyclonic separating device.

6. The cyclonic vacuum cleaner according to claim 5, characterized in that the central filter and the cyclonic separating device are mounted coaxially with respect to each other.

7. The cyclonic vacuum cleaner according to claim 5, wherein the central filter is positioned inside the air outlet of the cyclonic separating device.

8. The cyclonic vacuum cleaner according to claim 1, characterized in that the suction device is provided in an upper portion of the cyclonic separating device.

9. The cyclonic vacuum cleaner according to claim 8, wherein at least a portion of the suction device is positioned above the air outlet of the cyclonic separating device.

10. The cyclonic vacuum cleaner according to claim 1, characterized in that the suction device is provided in a lower portion of the cyclonic separating device.

11. The cyclonic vacuum cleaner according to claim 10, wherein at least a portion of the suction device is positioned below the air outlet of the cyclonic separating device.

12. The cyclonic vacuum cleaner according to any of claims 1-10, characterized in that the cyclonic separating device is a multi-stage cyclonic separating device, which is composed of a primary cyclonic separating device and a secondary cyclonic separating device arranged in series; wherein, the secondary cyclonic separating device consists of a plurality of secondary cyclone separators arranged in parallel with one another.

13. The cyclonic vacuum cleaner according to claim 12, characterized in that the secondary cyclone separators are provided above or below the primary cyclone separator, and is at least partially enclosed in the chamber body of the cyclonic separating device.

* * * * *